US007428866B2

(12) United States Patent
Reiche

(10) Patent No.: US 7,428,866 B2
(45) Date of Patent: Sep. 30, 2008

(54) DEVICE FOR TENSIONING AND CLOSING STRAPPING BANDS

(75) Inventor: Udo Reiche, Bornheim (DE)

(73) Assignee: Cyklop GmbH, Cologne (DE)

( * ) Notice: Subject to any disclaimer, the term of this patent is extended or adjusted under 35 U.S.C. 154(b) by 0 days.

(21) Appl. No.: 10/592,737

(22) PCT Filed: Feb. 21, 2005

(86) PCT No.: PCT/EP2005/001778

§ 371 (c)(1),
(2), (4) Date: Mar. 8, 2007

(87) PCT Pub. No.: WO2005/095214

PCT Pub. Date: Oct. 13, 2005

(65) Prior Publication Data

US 2007/0227370 A1 Oct. 4, 2007

(30) Foreign Application Priority Data

Mar. 15, 2004 (DE) ..... 10 2004 012 733

(51) Int. Cl.
*B65B 13/22* (2006.01)
*B65B 13/30* (2006.01)
*B65B 57/00* (2006.01)

(52) U.S. Cl. ..... 100/29; 100/4; 100/33 PB; 53/582; 53/589; 156/494; 156/502

(58) Field of Classification Search ..... 100/29, 100/30, 32, 33 R, 33 PB, 4; 53/582, 589, 53/592; 156/494, 502, 580, 581
See application file for complete search history.

(56) References Cited

U.S. PATENT DOCUMENTS

| | | | | |
|---|---|---|---|---|
| 6,470,941 | B1 | 10/2002 | Wehr | |
| 6,957,678 | B2 | 10/2005 | Scholl et al. | |
| 7,204,187 | B2 * | 4/2007 | Zeimetz et al. | 100/29 |
| 2003/0121611 | A1 | 7/2003 | Scholl et al. | |

FOREIGN PATENT DOCUMENTS

| | | |
|---|---|---|
| DE | 44 43 252 | 5/1996 |
| DE | 198 31 665 | 1/2000 |
| DE | 100 26 197 | 12/2001 |
| EP | 0 353 505 | 7/1989 |
| JP | 2000281009 A * | 10/2000 |

* cited by examiner

*Primary Examiner*—Jimmy T Nguyen
(74) *Attorney, Agent, or Firm*—Fay Sharpe LLP

(57) ABSTRACT

The device tensions and closes strapping bands for packaging and suchlike. It has a band channel open longitudinally on one side in the longitudinal direction of the strapping band, a band tensioning device acting in the area of the band channel and a closing device which joins the band ends lying on top of each other in a tensioned state in the band channel. In order to ensure that correct tensioning rate, band tension, welding time, holding time and/or other band closing parameters in each case, the device is provided with a sensor device recording the width of the strapping band and a processing and adjusting unit interacting therewith, with which the band closing parameters are automatically adjusted as a function of the band width.

13 Claims, 2 Drawing Sheets

DEVICE FOR TENSIONING AND CLOSING STRAPPING BANDS

BACKGROUND

The invention relates to a device for tensioning and closing strapping bands for packages and suchlike, with a band channel open on one side on a longitudinal side in the longitudinal direction of the band, a band tensioning device acting in the area of the band channel and a closing device which joins the band ends of the strapping bands lying on top of each other in a tensioned state in the band channel.

A device of this type is known, for example, from DE 100 26 197 A1/U.S. Pat. No. 6,957,678 B2. This known device is suitable for closing strapping bands of different widths. In order to do this a band stop is envisaged which laterally guides the band ends of the strapping band in the band channel and delimits the band channel internally, the position of which can be changed perpendicularly to the longitudinal direction of the strapping band. The band channel has, depending on the position of the stop, an appropriately large width for taking up a wide strapping band, and a narrower width for use of the device for a narrow band.

The ability to alter the band channel width with the aid of a laterally adjustable band stop in the known device allows bands of different widths to be easily processed with one and the same device. This, however, results in the problem that not only the bandwidth has to be set by the user by adjusting the stop, but also it becomes necessary to set the band closing parameters for each band to be processed. It is self-evident that a narrow strapping band cannot be tensioned with the same maximum tensioning force as a broad band and the optimum welding time, tensioning rate, holding time after welding or other band closing parameters for a broad band can be completely unsuitable for a narrow band. If a narrow band is processed with the band closing parameters applicable to a broad band, the narrow band and the strapped package can be easily damaged and/or the closure can be inadequate.

In the known device the closing parameters are therefore limited through appropriate programming of the electronic control system of the device to a maximum permissible value which is in general set to processing the band with the maximum width. The closing parameters can be manually regulated by the use of the device with the aid of an appropriate adjusting device, in the form of a potentiometer, for example, and thus be reduced for narrower bands.

Unfortunately it has been shown that due to unfamiliarity or convenience many users always operate the device with the maximum closing parameters values, thereby processing narrow bands with the same tensioning force, tensioning rate, welding time, holding time etc as broad bands and are then amazed and complain about the poor quality of the strapping closure produced in this way.

From DE 198 31 665 A1/U.S. Pat. No. 6,470,941 B1 a method and a device for welding bands of thermoplastic synthetic material are known in which the band ends of a strapping band located in the band channel are welded using a friction welding device. The heat supply required for welding is controlled at the welding point in dependence on the thickness of the bands to be welded to each other and the friction welding device is only switched off when a predetermined specified value is reached/fallen below. In this known device/method too, processing of bands of different widths with one and the same device is not envisaged and the aforementioned problems associated therewith do not occur.

From DE 198 31 665 A1 a method and a device for welding bands of thermoplastic synthetic material are known in which the band ends of a strapping band located in the band channel are welded using a friction welding device. The heat supply required for welding is controlled at the welding point in dependence on the thickness of the bands to be welded to each other and the friction welding device is only switched off when a predetermined specified value is reached/fallen below. In this known device/method too, processing of bands of different widths with one and the same device is not envisaged and the aforementioned problems associated therewith do not occur.

SUMMARY

The aim of the invention is to create a device of the type set out in the introduction with which strapping bands of different widths can be processed, ensuring that the bands of different width cannot be processed with unsuitable band closing parameters.

This aim is achieved with the invention through a sensor device directly or indirectly recording the width of the strapping band or its band ends and through a processing and adjusting unit interacting therewith for setting band closing parameters of the device in dependence on the band width determined by the sensor device.

In accordance with the invention the width of the processed band is determined by the sensor unit and the thus determined band width value is used by the processing and adjusting unit to select the band closing parameters to be adjusted so that damage to the band or package to be strapped or incorrect connection of the band ends is not possible due to incorrectly selected, more particularly too large closing parameters. Setting the closing parameters of the device to the processed band width is therefore taken from the user.

It is particularly advantageous if the sensor device is arranged on a band stop which is arranged on the outer or inner longitudinal side of the band channel and guides the band ends of the strapping band laterally and can be adjusted in its position within the band channel. If the lateral position of the band stop is adjusted perpendicularly to the longitudinal direction of the strapping band to be accommodated in the band channel in order to set the device another strapping band width, the sensor unit scans .this new position of the stop and in this way, in conjunction with the processing and setting unit, immediately ensures the correct, new selection of the adjustable band closing parameters.

In a known manner the closing device expediently and essentially comprises a welding unit. The band closing parameters adjustable by the processing and setting unit can, as has already been indicated, cover the maximum band tension achievable with the band tensioning device, the tensioning rate of the band tensioning device, the welding time of the closing unit and/or the holding time of the band ends welded together after the welding procedure.

Expediently the sensor unit essentially comprises at least one position indicator whose position can be changed depending on the position of the band stop and at least one position sensor that scans the position of the at last one position indicator. Thereby the at least one position sensor can be a reverberation sensor and the at least one position indicator can be a magnet which is coupled to the longitudinally adjustable band stop.

The band stop can be adjusted perpendicularly to the longitudinal direction of the strapping band in the band channel by means of an adjusting device, for example with a screwdriver or another suitable tool.

Other details and advantages of the invention are set out in the following description and the drawing in which a preferred form of embodiment of the invention is explained in more detail by way of the example.

DETAILED DESCRIPTION

Figure 1:
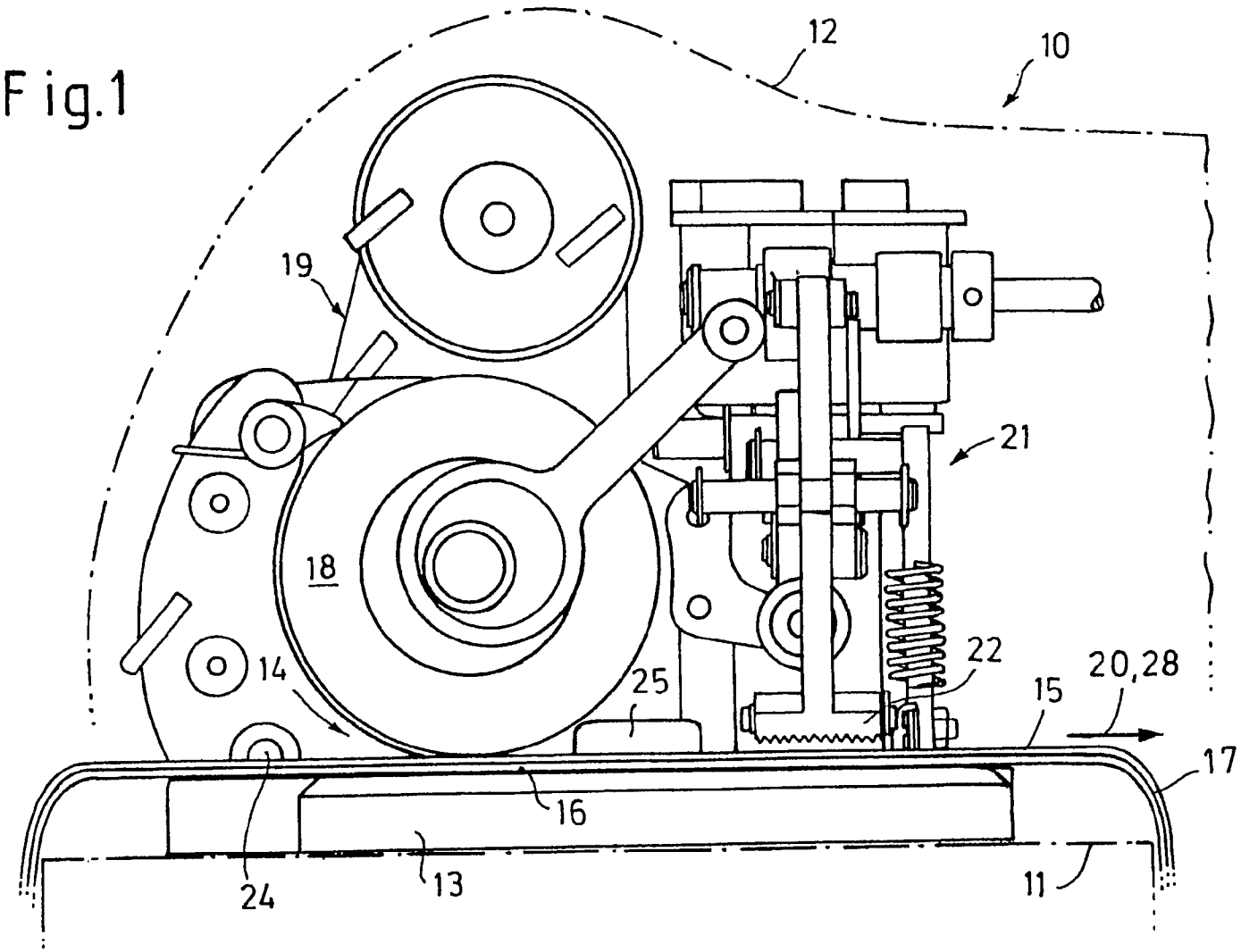
FIG. 1 shows a side view of a device in accordance with the invention for tensioning and closing strapping bands, omitting the device casing.

The device designated 10 in its entirety in the drawing serves to tension and close synthetic strapping bands for packaging, for example a box 11, as indicated in FIG. 1. The device has a casing 12, shown only as broken line in FIG. 1, and a lower base plate 13, which forms the bottom limit of a band channel 14 arranged laterally in the casing 12. The band channel 14 is arranged on a longitudinal side of the case and is laterally open so that both band ends 15, 16 of the strapping band 17 can be inserted from the side of the device to overlap in the band channel in a known manner. To tension the strapping band the upper band end 15 is pulled with the aid of a band tensioning device 19 which has a tensioning roller 18 over the lower band end 16 which lies firmly on the upper side of the base plate 13 and therefore is not involved in the movement of the upper band end.

In the pull-through direction 20 of the upper band end 15 arranged in the casing 12 behind the tensioning roller is a friction welding device 21 which on achieving the required band tension is triggered, whereby an oscillator plate 22 which delimits the band channel above the two band ends is lowered onto the upper band end 15 and moves this to and fro at high speed perpendicularly to the tensioning direction 20 over the lower band end 16 so that the thus produced friction heat brings about welding of the two band ends in this area.

The method of functioning of such devices and their basic structure described so far are known and will not be explained in more detail.

Figure 2:
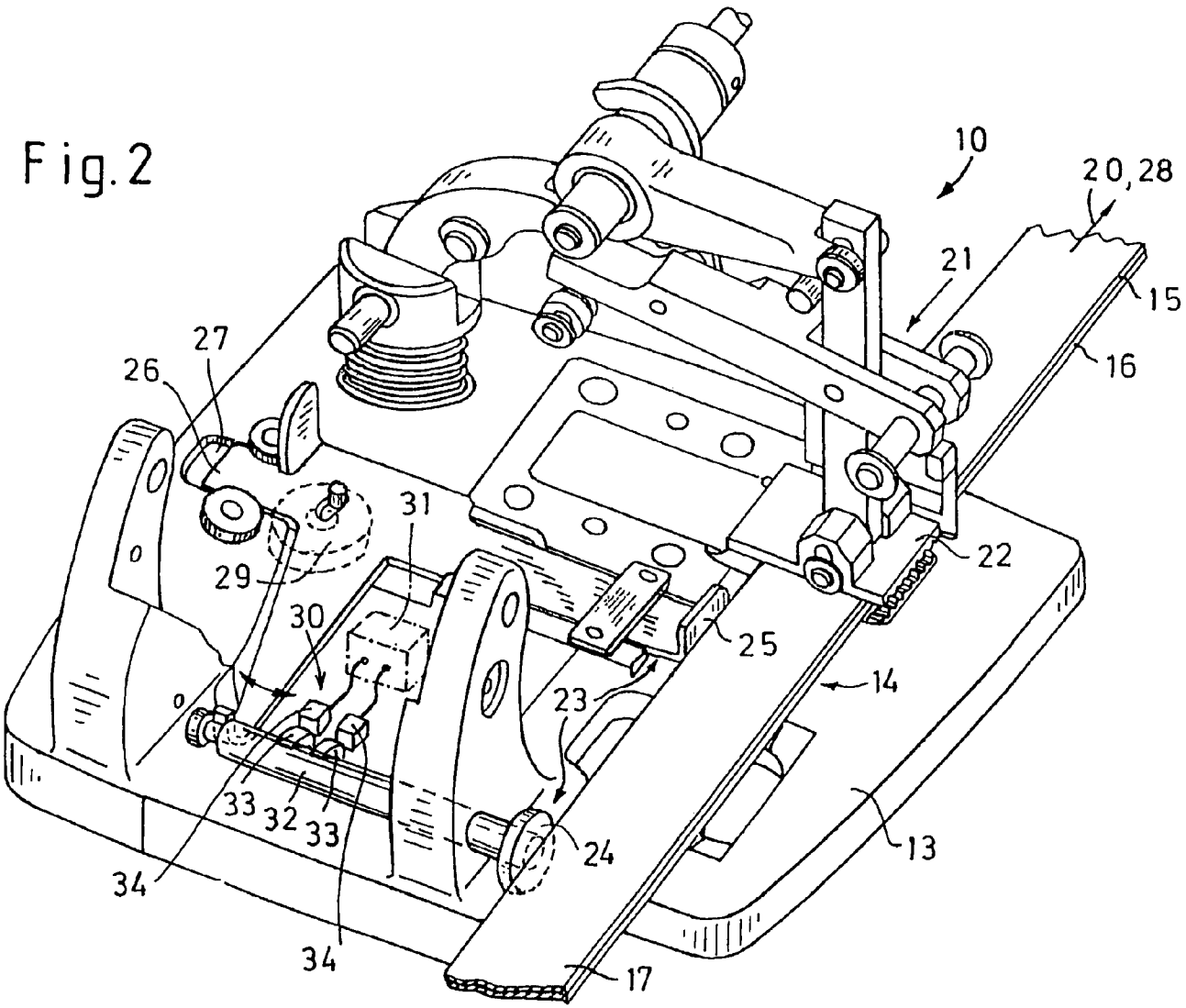
FIG. 2 is a perspective view of the object in FIG. 1.

As can best be seen from FIG. 2, the band channel 14 is limited at its inner longitudinal side by a band stop 23 which essentially comprises a forward band stop element 24 and a rear band stop element 25 which are connected to a joint pusher 26. The pusher is movable in a guide 27 on the base plate 13 perpendicularly to the longitudinal direction 28 of the strapping band and can with the aid of an adjusting mechanism 29 be laterally moved and stopped in certain positions, whereby the two band stop elements 24, 25 of the band stop 23 are also brought into different positions in the band channel 14, into which, depending on the position of the band stop elements, strapping bands of different widths can be inserted. In practice band widths of 10 mm, 13 mm, 16 mm and 19 mm are commonly used; accordingly in the preferred form of embodiment the band stop elements can, with the aid of an adjusting mechanism accessible from the underside of the base plate and operable with a screwdriver, be brought into four different positions in the band channel each differing approx. 3 mm in depth.

During the processing of strapping bands of different widths it is necessary to set the band closing parameters such as, for example, the band tensioning rate of the band tensioning device 19, the welding time of the friction welding device 21, the holding time in which the two bend ends to be welded are still pressed to each other after the welding process, before the device can be removed from the strapping band, and, in particular the band tension achievable with the band tensioning device. It is easy to understand that a narrow band of approx. 10 mm width can be exposed to a lower maximum tensioning force than a broader band, and the welding time for such a broader band may possibly have to be selected to be greater than for the narrow band. In the past the different parameters required for processing bands of different widths were set manually by the user of the device, for which purpose a potentiometer accessible from the outside of the casing was provided, with which the variable closing parameters could be adjusted to the relevant band width. However, the known embodiment had the disadvantage of repeated operating errors, namely when the users forgot to adjust the potentiometer along with the band stop 23 to change the welding parameters when processing a new, broader or narrower band.

To avoid this problem the device in accordance with the invention is provided with a sensor device 30 and a processing and adjusting unit 31 interacting therewith which is only shown schematically in the drawing in FIG. 2 and which serves to automatically set the band welding parameters of the device on the electronic control system (not shown) as a function of the band width determined by the sensor device 30. For this the sensor device is arranged on the band stop 23 in the area of the forward band stop element 24 and essentially comprises two position indicators 33 in the form of two magnets arranged on a guide rod 32 of the front band stop element 24 and two position sensors 34 for scanning the position of the two magnets which in a preferred form of embodiment are designed as reverberation sensors. Depending on the position of the of the two magnets arranged on the guide rod 32 relative to the two reverberation sensors they have different output signals or switching positions, whereby the different output signal combinations "0-1", "1-1", "1-0" and "0-0" stand for the four different possible settings of the band stop in the band channel and thereby for the four different band widths. The appropriate output values of the sensors are transmitted to the processing and adjusting unit and this then sets the band welding parameters to be adjusted on the band tensioning device and/or the welding device to the value for the band width selected by the user of the device via the adjusting mechanism 29 on the band stop 23.

This design effectively prevents a narrow band being tensioned with too great a maximum band tension or the welding time for the narrow band being too long, or the other adjustable band closing parameters being selected too high or too low. Accordingly it is also ensured that when using a broad band the maximum band tension is correspondingly greater and that the other band closing parameters are selected correctly, as the selection of the band welding parameters takes place automatically when setting the band stops for the band width to be processed, without the user of the device making errors as in the previously usual manual adjustment of the band closing parameters.

The invention is not restricted to the described and illustrated example of embodiment but various modifications and additions are conceivable without going beyond the scope of the invention. For example, it is possible for automatic setting of the band welding parameters not only to take in account the band width, but also the material of the strapping band that can be entered by hand.

The invention claimed is:

1. Device for tensioning and closing strapping bands for packages, the device comprising:

a base plate, a band channel open at one side of the base plate in a longitudinal direction of the band, a band tensioning device acting in an area of the band channel, a closing device which joins band ends of the strapping band lying on top of each other in a tensioned state in the band channel, a sensor device directly or indirectly recording a width of the strapping band, an adjustable band stop arranged on the base plate, at least a portion of the sensor device arranged on the adjustable band stop, and a processing and adjusting unit interacting with the sensor device to adjust band closing parameters of the device as a function of the band width determined by the sensor device.

2. Device in accordance with claim 1, wherein the adjustable band stop is arranged on the outer or inner longitudinal side of the band channel which laterally guides the band ends of the strapping band and adjusts its position within the band channel.

3. Device in accordance with claim 1, wherein the closing device comprises a welding unit.

4. Device in accordance with claim 1, wherein band closing parameters adjustable by the processing and adjusting unit include a maximum band tension achievable with the band tensioning device.

5. Device in accordance with claim 2, wherein the sensor device comprises at least one position indicator that changes position depending on a position of the band stop and further comprises at least one position sensor that scans the position of the at least one position indicator.

6. Device in accordance with claim 5, wherein the at least one position sensor is a reverberation sensor and the at least one position indicator is a magnet which is coupled to the adjustable band stop.

7. Device in accordance with claim 2, wherein the band stop is laterally adjustable perpendicularly to the longitudinal direction of the strapping band in the band channel by means of an adjusting device.

8. Device in accordance with claim 3, wherein band closing parameters adjustable by the processing and adjusting unit include a maximum band tension achievable with the band tensioning device, a welding time of the closing device and/or holding time of the band ends welded to each other after a welding procedure.

9. Device in accordance with claim 5, wherein the band stop is laterally adjustable perpendicularly to the longitudinal direction of the strapping band in the band channel by means of an adjusting device.

10. A device for tensioning and closing strapping bands for packages said device comprising:

a band channel;

a band tensioning device acting in an area of the band channel to tension an associated strapping band;

a closing device that joins overlapped ends of the associated strapping band in a tensioned state in the band channel;

a sensor device that records a width of the associated strapping band;

an adjustable band stop, at least a portion of the sensor device arranged on the adjustable band stop;

a processing and adjusting unit interacting with the sensor device, said processing and adjusting unit adjusting at least one band closing parameter of the closing device as a function of the band width determined by the sensor device.

11. A method for tensioning and closing strapping bands for packages, said method comprising:

tensioning a strapping band in a band channel, said strapping band having overlapped ends;

sensing a width of the associated strapping band with a sensor device, at least a portion of the sensor device arranged on an adjustable band stop;

joining said overlapped ends of said strapping band to each other in a tensioned state m the band channel, said joining step comprising adjusting at least one band joining parameter as a function of the width of the strapping band determined in said sensing step.

12. The method as set forth in claim 11, wherein said at least one band joining parameter comprises at least one of a maximum band tension, a welding time for welding said overlapped ends, and a holding time for holding the overlapped ends together after said joining step.

13. A device for tensioning and closing strapping bands for packages comprising:

a base plate;

a band channel open at one side of the base plate;

a band tensioning device acting in an area of the band channel;

a closing device for joining band ends lying on top of each other in the band channel;

a sensor device directly or indirectly recording strapping band width;

a processing and adjusting unit interacting with the sensor device to adjust band closing parameters of the closing device as a function of band width as determined by the sensor device;

at least a portion of said sensor device arranged on a band stop arranged on an outer or inner longitudinal, side of the band channel which laterally guides the band ends of the strapping band and adjusts its position within the band channel.

* * * * *